US005404820A

United States Patent [19]

Hendrix

[11] Patent Number: 5,404,820

[45] Date of Patent: Apr. 11, 1995

[54] NO MOVING PARTS SAFE & ARM APPARATUS AND METHOD WITH MONITORING AND BUILT-IN-TEST FOR OPTICAL FIRING OF EXPLOSIVE SYSTEMS

[75] Inventor: James L. Hendrix, Overland Park, Kans.

[73] Assignee: The United States of America as represented by the Department of Energy, Washington, D.C.

[21] Appl. No.: 257,316

[22] Filed: Jun. 9, 1994

[51] Int. Cl.[6] ..... F42C 15/40

[52] U.S. Cl. ..... 102/201; 367/140

[58] Field of Search ..... 102/201; 367/140, 149

[56] References Cited

U.S. PATENT DOCUMENTS

| | | | |
|---|---|---|---|
| 3,812,783 | 5/1974 | Yang et al. | 102/201 |
| 4,099,161 | 7/1978 | Wolski | 340/147 |
| 4,391,195 | 7/1983 | Shann | 102/201 |
| 4,635,552 | 1/1987 | Battle | 102/254 |
| 4,899,659 | 2/1990 | Hardt | 102/229 |
| 4,917,014 | 4/1990 | Loughry et al. | 102/201 |
| 5,138,946 | 8/1992 | Soltz et al. | 102/201 |
| 5,204,490 | 4/1993 | Soltz et al. | 102/201 |
| 5,206,455 | 4/1993 | Williams et al. | 102/201 |
| 5,353,262 | 10/1994 | Yakymyshyn et al. | 367/149 |

*Primary Examiner*—Charles T. Jordan
*Assistant Examiner*—Theresa M. Wesson
*Attorney, Agent, or Firm*—Luis M. Ortiz; James H. Chafin; William R. Moser

[57] ABSTRACT

A laser initiated ordnance controller apparatus which provides a safe and arm scheme with no moving parts. The safe & arm apparatus provides isolation of firing energy to explosive devices using a combination of polarization isolation and control through acousto-optical deviation of laser energy pulses. The apparatus provides constant monitoring of the systems status and performs 100% built-in-test at any time prior to ordnance ignition without the risk of premature ignition or detonation. The apparatus has a computer controller, a solid state laser, an acousto-optic deflector and RF drive circuitry, built-in-test optics and electronics, and system monitoring capabilities. The optical system is completed from the laser beam power source to the pyrotechnic ordnance through fiber optic cabling, optical splitters and optical connectors. During operation of the apparatus, a command is provided by the computer controller and, simultaneous with laser flashlamp fire, the safe & arm device is opened for approximately 200 microseconds which allows the laser pulse to transmit through the device. The arm signal also energizes the laser power supply and activates the acousto-optical deflector. When the correct fire format command is received, the acousto-optic deflector moves to the selected event channel, and the channel is verified to ensure the system is pointing to the correct position. Laser energy is transmitted through the fiber where an ignitor or detonator designed to be sensitive to optical pulses is fired at the end of the fiber channel. Simultaneous event channels may also be utilized by optically splitting a single event channel. The built-in-test may be performed anytime prior to ordnance ignition.

17 Claims, 5 Drawing Sheets

NO MOVING PARTS SAFE & ARM APPARATUS AND METHOD WITH MONITORING AND BUILT-IN-TEST FOR OPTICAL FIRING OF EXPLOSIVE SYSTEMS

The present invention was conceived and developed in the performance of a U.S. Government Contract. The U.S. Government has rights in this invention pursuant to contract No. DE-ACO4-76DP00613 between the United States Department of Energy and AlliedSignal Aerospace Company.

FIELD OF THE INVENTION

The present invention relates generally to safe and arm safety devices for explosive devices. More particularly, the invention is directed to a safe and arm scheme for optical/laser-based explosive ignition/detonation systems utilizing electro-optical and acoustic-optical devices to perform the isolation functions that keep an energy source from the ignitor/detonator. The invention is adaptable to ordnance ignition systems, optic and laser systems, air crew emergency escape systems, and space vehicle explosive event ignition and initiation systems.

BACKGROUND OF THE INVENTION

In the field of safe & arm mechanisms, the only previously known methods for providing safe & arm functions for optical firing systems entail the use of moving prisms or shutters, or nonmoving saturable absorbing materials. These approaches provide reasonable safety but either have moving parts that lower reliability or cannot be monitored actively to determine their safe or armed status. Ignitors using prior art safe & arm schemes or laser diode sources are also susceptible to electrostatic discharge, radio frequency interference or electromagnetic interference which increases the risk of accidental detonation.

Thus, there is an existing need for a safe & arm scheme that will ensure safety by providing a safe & arm scheme for optically/laser based explosive ignition/-detonation systems with minimal or no mechanical part movement and which allow for constant monitoring and self-testing techniques to ensure safety. It is a further object of the invention to enhance ignitor/initiator resistance to electrostatic discharge, radio frequency interference, and electromagnetic interference (including lightning) through the use of fiber optics to deliver optical energy to the pyrotechnic ignitor instead of using wires that can act as antennas to conduct stray electrical energy towards ignitors resulting in an unintended explosive event.

SUMMARY OF THE INVENTION

It is therefore an object of the present invention to fulfill the need for a safe & arm scheme with the ability to continuously monitor, directly through thle firing path, the state of a safe & arm system with increased reliability and testability afforded by a non-moving parts configuration and the ability to perform 100% built-in testing at any time without the possibility of an accidental explosive firing. In view of the above-described needs, the present invention provides isolation of firing energy from pyrotechnic ignitors/detonators using a combination of polarization isolation and control through acousto-optical deviation of a laser energy beam. This technique does not require moving parts and provides constant monitoring capability of the safe or armed status of the system. In addition, a 100 percent built-in-test can be safely performed at any time without the risk of unintended explosive events.

The preferred embodiment of the laser initiated ordnance controller (LIOC) of the present invention consists of a computer controller, a solid state laser and laser power supply, an acousto-optic deflector (AOD) and RF drive circuitry, optical splitters and fiber optic cables, Built-in-Test (BIT) optics and electronics, and an electro-optical (EO) safe & arm device with its drive electronics. During operation, the LIOC receives command signals from a control panel or remote computer of a flight system that provides BIT, Arm, and Fire commands. The LIOC provides BIT information in the form of Go/No-Go and failure isolation to the firing channel level. The BIT performs a fiber optic continuity, loss, and laser pointing test of the transmission optics and an energy available measurement on the primary laser. Given the proper arm commands, the Safe & Arm aspect of the device is activated to either the safe or arm mode.

When the device is in either the de-energized or safed state there is less than a 1 in 100,000,000 chance of an accidental firing. In the safed state each device may be interrogated to determine its current status. This status may include continuity, alignment, loss, energy output, etc. Once the system reports its status and it is determined to be fully operational, the system can be armed. The armed status is realized by the receipt of an arming signal. This arming signal charges the laser electronics. When the firing sequence is then received, the acousto-optical deflector is programmed to deflect each successive laser pulse to the previously programmed events in that sequence. The system can also be aborted at any time via an abort signal that would interrupt the firing sequence to perform a special (e.g. self-destruct) event. On the firing signal the laser flashlamp is fired simultaneous with the polarization switch activation. The polarization switch remains open for approximately 200 microseconds which allows the laser pulse to be transmitted to the next element in the firing chain, the AOD. The AOD has been activated by an RF signal that directs the laser pulse to a specific firing channel. The channel can be verified immediately prior to firing to verify the correct channel is chosen and that the pulse will be aligned. Once the pulse has passed through the AOD, it is coupled into a fiber optic via a lens focusing system. The fiber optic then conveys the light pulse to an explosive ignitor or detonator. Simultaneous events are also possible through the use of a splitting device which can practically address from two to twenty simultaneous explosive events.

Additional objects, advantages, and novel features of the invention will become apparent to those skilled in the art upon examination of the following description or may be learned by the practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form part of the specification, illustrate embodiments of the present invention and, together with the description, serve to explain the operation, features, and advantages of the invention.

DETAIL DESCRIPTION OF THE PREFERRED EMBODIMENTS

Figure 1:
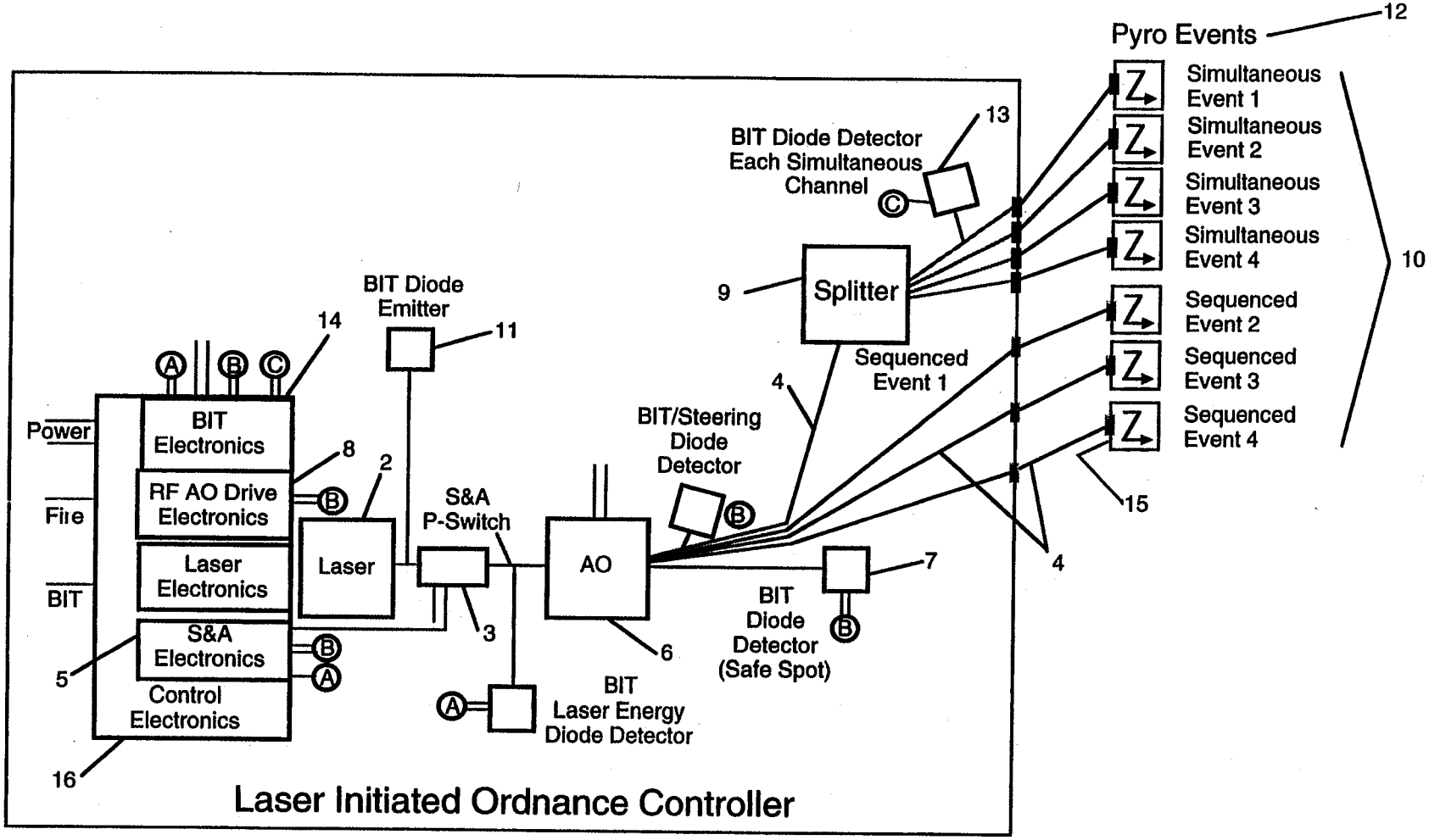
FIG. 1 is a block diagram of the laser initiated ordnance control safe and arm scheme of the present invention.

In order for an ordnance device to be ignited, a laser beam source must be connected to the desired fiber optics channel which then delivers the beam's energy to the pyrotechnic ordnance. Referring to FIG. 1, a laser 2 is interconnected with fiber optics 4 using an acousto-optical sequencer/deflector (AO) 6. An operational AO deflector consists of an AO deflector 6, AO drive electronics 8, and input imaging optics (not shown). The preferred AO deflector is an off-axis tellurium dioxide device which has high coupling efficiency, high contrast ratio, large deflection angles, and is capable of coupling a laser beam into multiple fiber optic channels 10. A high power laser beam is directed to a precise angular position via the AO. The basic mechanism for all AO interaction is the induced change in the index of refraction within an optical material. This phenomenon is known as the photoelastic effect. Through the AO, the photoelastic effect is capable of defracting a laser beam in the presence of an acoustic wave. The acoustic waves may be thought of as a diffraction grating made by changing the period in the optical phase, moving at sonic velocity. Alternatively, the light and sound may be thought of as photons and phonons undergoing collisions in which energy and momentum are conserved.

The AO is optically active for light propagating along the [001] (crystal axis orientation) direction. The index of refraction for the two polarization vectors are different and the plane of polarized light undergoes a rotation by an amount:

$$R=2n_0\delta/\lambda$$

where $$\delta=n_1-n_2/2n_0.$$

Figure 2:
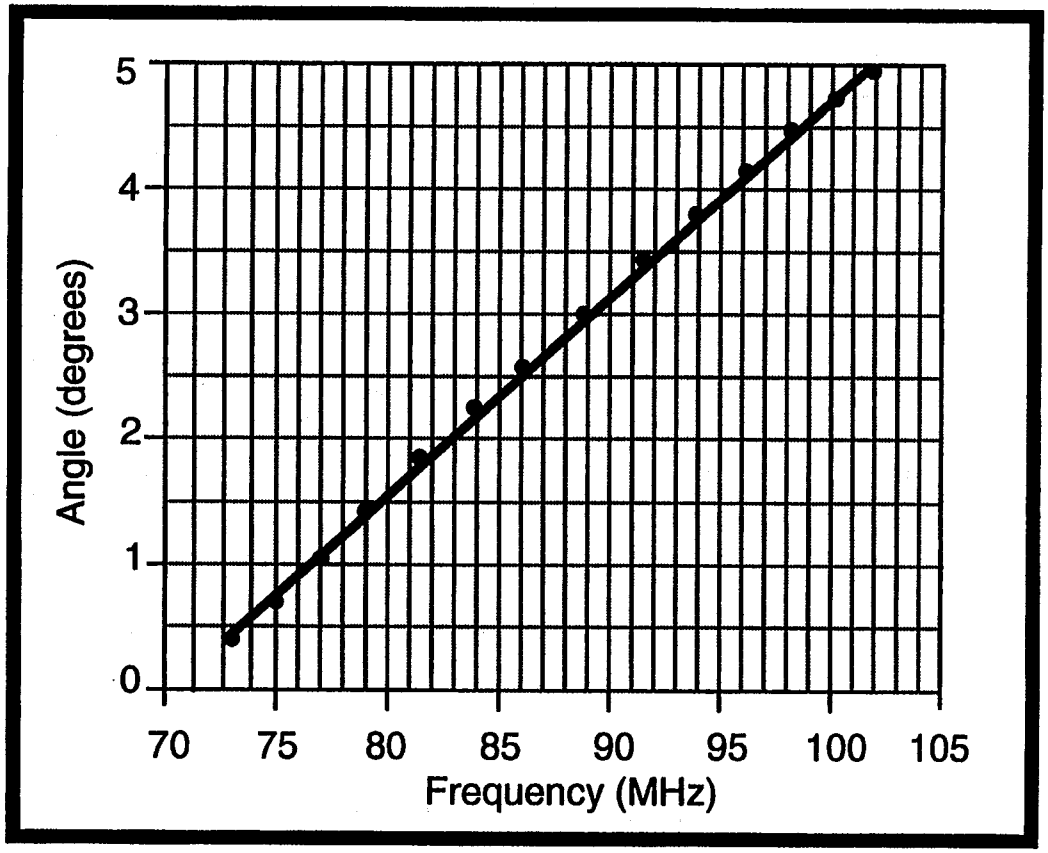
FIG. 2 is a graphical illustration of experimental results using an off-axis $TeO_2$ device, where the deflection angle is shown as a function of RF power.

Experimental results using the off-axis $TeO_2$ device deflection angle as a function of RF frequency is presented in FIG. 2. The device shows a deflection angle of approximately 4.5 degrees for a 36 MHz bandwidth wherein the angular difference over 36 MHz (=100−74) is 4.5 (=5−0.5). With a deflection angle of approximately 85 milliradians and a laser source which has a divergence of 7 milliradians, the laser beam can be addressed and coupled into approximately 12 fiber channels. This provides at least a factor of four in expandability over the current space launch vehicle system requirement for the number of sequential events. Using the preferred AO reduces problems typically experienced by other coupling devices such as poor efficiency, small scan angles, and temperature instability.

Figure 3B:
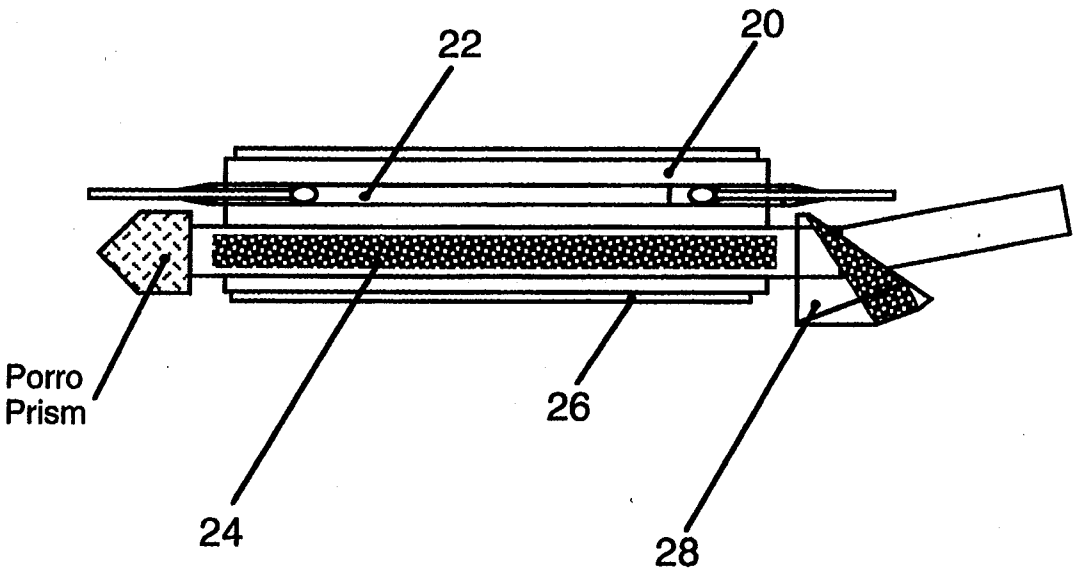
FIG. 3 is an illustration of the pump cavity and laser resonator used by the invention.
Figure 3A:
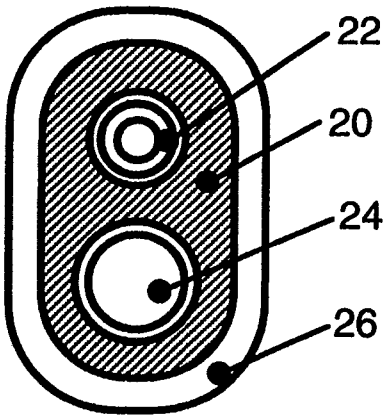

The preferred laser used by the LIOC is a crossed Porro prism, polarization output coupled design that has proven its ruggedness and reliability in the harsh environments of the military battlefield. This resonator provides a means to control the effects of environmentally induced misalignments which would otherwise compromise performance. The preferred laser is either flashlamp or laser diode pumped. The pump cavity design, illustrated in FIG. 3, provides for high energy coupling efficiency which helps minimize the power supply size, weight, volume, electrical demands and heat dissipation. The pump cavity 20 concentrates light from the flashlamp 22 into the laser rod 24. The laser rod 24 then converts the flashlamp energy into laser energy. The key feature of this pump cavity is the close coupled geometry combined with the broad band diffuse reflector 26. A prism 28 can be used to direct the laser beam towards receiving fiber optics (not shown).

Figure 4:
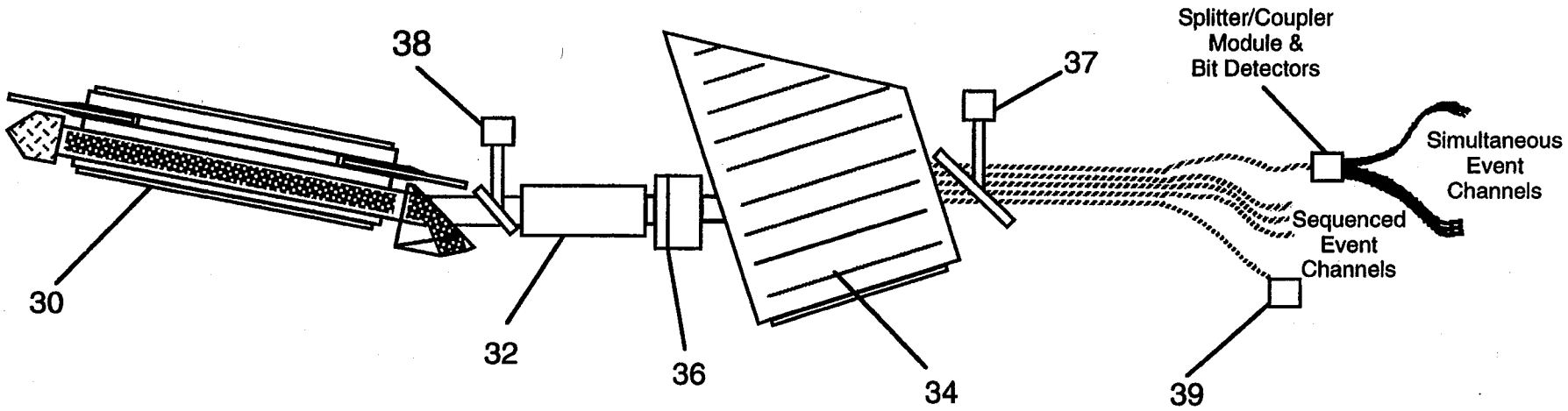
FIG. 4 is an illustration of the key optical devices used for the safe and arm features of the laser initiated ordnance controller.

The safe & arm (S&A) features of the LIOC are illustrated in FIG. 4. The key devices in the optical segment of the S&A are the laser itself 30, the polarization switch (P-switch) 32, and the acousto optic deflector 34. These devices each provide between 20 and 40 dB of attenuation in the off condition. Each requires a different form of energy to function. The laser requires two separate high voltage signals with precise timing between the two. The P-switch requires a very precise voltage level and precise timing relative to the laser which is different from the laser flash lamp timing signals. The acousto-optic deflector requires precise and discrete levels of low voltage rf energy to function at discrete levels to access an active fiber optic channel.

The signals must be timed to within microseconds of each other. The P-switch 32 must have its voltage controlled around that nominal voltage to within about 300 V. In addition the RF and DC voltage on the acousto-optical (AO) deflector 34 must combine to address a valid event channel. Furthermore, each of these drive energy forms is controlled by electrical S&A protection.

There is a fourth passive component in the system that capitalizes on the polarization rotation of the AO deflector 34 in the scanning mode to provide an additional 23 dB of isolation. This fourth component is a thin film polarizer (TFP) 36. The fundamental premise of the optical S&A scheme is polarization control. The laser 30 and a BIT diode 38 are linearly polarized orthogonal to each other. In the off condition, the P-switch 32 will only pass the BIT diode polarization and blocks the laser polarization. When the arm signal is applied to the P-switch 32 the laser polarization is passed and the BIT diode polarization is blocked. The laser 30 can be test fired to measure energy if the P-switch 32 and the AO deflector 34 both are safed and verified safe. The verified safe is accomplished by a safe spot position monitoring detector 39. This detector must be receiving energy from the BIT diode 38 which is only possible when the P-switch 32 is in the safe condition and the AO deflector 34 is off (not deflecting). The polarization of the input beam is rotated by the AO deflector 34; thus if the deflector is not activated, light cannot be passed through the deflector 34.

Given the proper arm commands the Safe & Arm device is activated. This means that simultaneous with flashlamp fire, the S&A device is opened for approximately 200 microseconds which will allow the laser pulse to transmit through the device. An ARM signal will also energize the laser power supply and activate the acousto-optic deflector. When the correct format fire command is received: the deflector moves to the selected event channel; the correct channel is verified ensuring that the system is pointing to the correct position; the flashlamp fire signal is generated and the S&A device is opened; the laser fires; the laser pulse is transmitted through the S&A device; the scanner redirects the beam into the correct event channel; the light is coupled into an optical fiber; in the simultaneous event channels the light may be split into multiple fibers; the laser energy pulse is transmitted down the fibers; and the pyrotechnic charge(s) is(are) ignited.

The LIOC hardware can preferably fire 4 sequential event channels. As stated before, one of these channels can split the signal into 4 or more simultaneous event channels. The scanner and modular approach would allow for up to 15 sequential events. The number of simultaneous events is a function of the laser energy available and the loss caused by fiber optic connections. A practical limit is about 20 simultaneous events.

The three optical S&A devices may work in pairs of two to ensure that there is a minimum of 60 dB (1,000,000:1) safety margin at all times. All of the optical components are proven rugged and reliable in military environments as mentioned previously and designed with high laser damage threshold (used in Q-switched laser) for high reliability.

Figure 5:
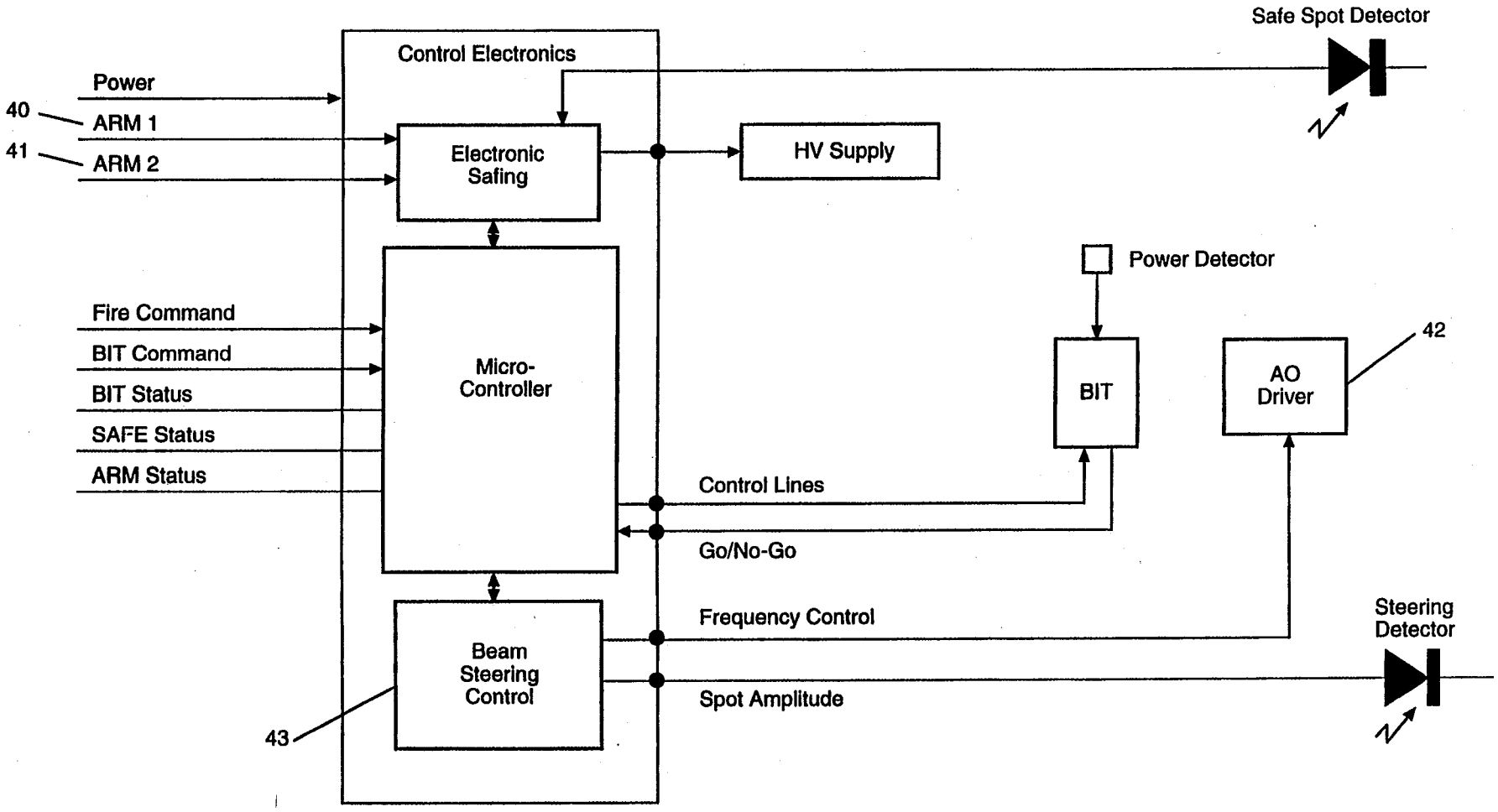
FIG. 5 is a block diagram of the safe & arm control electronics.

S&A electronics 5, as illustrated in FIG. 1, can control high voltage to the laser 2, the electro-optical polarization switch 3 and the acousto-optic deflector 6 which controls the function of the active optical elements and thus prevent optical energy from reaching the pyrotechnic device except when the system is armed. Referring to FIG. 5, arming the system may require the presence of two independent arming command signals 40 and 41 and the targeting of the acousto-optical deflector 42 and 43 into a valid event channel. Referring to FIG. 1, the absence of any of these conditions requires the monitored targeting of the beam onto the safe spot 7 through the acousto-optical deflector 6, and grounded connections to both the laser flashlamp 2 and the electro-optical polarization switch 3. The absence of any of these conditions results in the disabling of the other arming conditions.

Referring back to FIG. 1, the control electronics 16 in the LIOC communicate with a system panel (not shown) to accept commands from the user and indicate system status to the user. The hardware can communicate via a 1553 data bus rather than with the front panel controls and indicators. AO control, S&A, BIT, high voltage generation for the laser flashlamp and polarization shutters, and the power supply can be controlled by the control electronics 16. The commands and control logic centers around an embedded microcontroller system which can be programmable in Ada.

Optical splitters 9 provide a means to perform multiple simultaneous events from one channel. The splitter takes light from a single event channel 4 and splits it into multiple simultaneous events. In general, the energy pulse comes from one fiber optic channel and leaves the splitter in 2 or more fiber optic channels. Simple distributed splitters, binary phase gratings, fiber bundle splitters, and integrated optics splitters may be utilized for this purpose and their applications, benefits and drawbacks are well known in the art.

The LIOC provides BIT information in the form of GO/NO-GO and failure isolation to the channel level. The BIT 14 performs a continuity, loss, and pointing test of the transmission optics and an energy available measurement on the primary laser. The LIOC BIT system monitors laser 2 output and checks the integrity of the entire optical path from a BIT light source 11 to each pyrotechnic device 12 coupled to the LIOC system. Optical path integrity checking is achieved by sending a short pulse of about 910 nm radiation through the AO deflector 6 into the fiber optic distribution system 4. Optical energy is reflected from the pyrotechnic device window 15, specially coated to reflect the BIT wavelength, and is detected and compared to a threshold value chosen to discriminate against the Fresnel reflections from other optical surfaces in the train. The optical path is judged to be intact if a superthreshold pulse (or train of pulses in the case of simultaneous event fiber channels) is detected. The BIT LED 11 delivers about 1 mW of optical power at 910 nm in a 10 ns pulse. The optical energy is focused internally into a 400 micron diameter optical fiber and then collimated. The resulting beam passes into the AO deflector 6, which directs it into the desired event channel 4. The fiber mounted at the targeted event 10 collects the optical energy and transmits it to the window 15 near the pyrotechnic device 12, which is specially coated to reflect the BIT wavelength with very high efficiency. The nearly total reflection of this energy back into the fiber results in a return pulse that is much stronger than the Fresnel reflections from uncoated fiber connections or a break in the fiber. After traveling back through the fiber, the light is folded into the BIT photodetector 13. A comparator in the electronics performs thresholding and converts the signal to a TTL level. If the target spot leads to a single fiber, then only a single pulse is expected, and detection of that pulse with a strength exceeding the threshold would indicate that the fiber is intact. The BIT provides assurance that the firing system is ready to perform its function at the time of test. The BIT design allows this test at any desired time, but testing immediately prior to pyrotechnic ignition offers the greatest benefit in mission quality over present firing systems. The improvement over prior art firing systems, which do not allow end-to-end testing is apparent to those versed in the art.

The sequence of BIT events and measurements is as follows:

(1) The safe status of the S&A device and the scanner is verified by the BIT laser diode; (2) the laser power supply is energized and the laser fires, redirecting energy by the S&A device into a photodetector that measures the energy available from the laser; (3) the laser electronics are safed; (4) the BIT laser diode again fires and performs a point alignment calibration; (5) the deflector scans to the first fiber channel to be tested; (6) the BIT LED fires and a pulse is coupled into the fiber channel which transmits down the fiber to the ignitor where it is reflected by the special dielectric coating that provides isolation from the pyrotechnic; (7) the reflected light is transmitted back up the fiber optic cable to a fold mirror that redirects the light into a photo detector which measures the loss and continuity of the fiber; (8) the AO steps to the next fiber channel and steps 6 and 7 are repeated; (9) once all of the fibers have been interrogated the result of BIT are reported. Thus a 100% end-to-end Built-In-Test is achieved. The LIOC S&A concept utilizes a multi-fold, multi-featured approach that provides a minimum of 100,000,000:1 isolation between the primary laser and the pyrotechnic ignitors.

The foregoing description of the invention has been presented for purposes of illustration. It is not intended to be exhaustive or to limit the invention to the precise forms disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated, as long as the principles described herein are followed. Thus, changes can be made in the above-described invention without departing from the intent and scope thereof. Therefore, it is intended that the specification and the examples be considered as exemplary only, with the true scope and spirit of the invention being indicated in the following claims.

What is claimed is:

1. A laser initiated ordnance control safing and arming apparatus having no moving parts, comprising:

a laser beam source for providing laser beam power through fiber optics to an explosive ordnance device for ignition or initiation;

a polarization switch for blocking said laser beam power while said switch is inactivated and for passing said laser beam power while said switch is activated;

an acousto-optical laser beam deflector means and associated radio frequency means for receiving said laser beam power and for adjusting the angle of travel of said laser beam source through said deflector means based on radio frequency power from said radio frequency means at said deflector means so that said laser beam power may be directed towards one or a plurality of fiber optic channels to ignite a pyrotechnic or detonator ordnance at said channels;

a plurality of fiber optic channels for receiving said laser beam power from said deflector means; and a computer controller for controlling said acousto-optical deflector, said laser beam source, said polarization switch, and for performing a built-in-test of fiber optics and electronics within said safing and arming apparatus prior to pyrotechnic ignition or detonator initiation.

2. The apparatus of claim 1, further comprising a monitoring means for monitoring the operational status of said plurality of fiber optic channels, said acousto-optical deflector, said laser beam source, and said polarization switch.

3. The apparatus of claim 1, wherein said computer controller is connectable to a user control panel to enable said controller to receive test, arm, safe and fire commands from an operator and to provide operational status information to said operator.

4. The apparatus of claim 1, further comprising optical splitting means coupled to at least one of said plurality of fiber optic channels wherein said optical splitting means provides a plurality of simultaneous event channels for simultaneous detonation of multiple pyrotechnic ordnance from said at least one channel.

5. The apparatus of claim 1, wherein said built-in-test performed by said controller provides GO, NO-GO and failure isolation information for said plurality of fiber optic channels.

6. The apparatus of claim 5, further comprising a low-power light source and a detector means, wherein the integrity of fiber optics of said apparatus is checked by the transmission of a low-power test-light source from said low-power light means to pyrotechnic ordnance coupled to fiber optic channels and wherein the test-light source is reflected off said ordnance which are coated to reflect the test light wavelength and said reflected light is then detected by said detecting means and analyzed by said controller to determine optical integrity of said apparatus.

7. The apparatus of claim 6, wherein said detecting means is a photodetector and said low-power test-light source is an LED.

8. A method of testing, safing and arming a laser initiated ordnance controller system, comprising the steps of:

testing the optical and electrical integrity of said system using built-in-test methods;

providing activation commands to activate the system wherein simultaneous with laser flashlamp fire a safe & arm device is opened to allow the laser pulse to transmit through the system;

providing an ARM signal to energize a laser beam source and acousto-optical deflector;

providing a fire command to the system which enable the deflector to move to a selected event channel;

verifying the selected event channel;

a flashlamp fire signal is generated and the safe & arm device is opened;

the laser fires an energy beam through the safe & arm device, the acousto-optic deflector, and is coupled into fiber optics of said selected channel; and the pyrotechnic ordnance coupled to the end of said fiber optic of said selected channel is ignited.

9. The method of claim 8, wherein during said testing:

a) the safe status of the safe & arm means and the acousto-optic deflector is verified by a laser source;

b) the laser power supply is energized and the laser fires, wherein the energy is redirected by the safe & arm means into a measuring means that measures the energy available from the laser;

c) the laser electronics are safed;

d) the LED again fires and performs a point alignment calibration through the acousto-optic deflector;

e) the deflector is acoustically positioned into the first fiber channel;

f) the LED fires a pulse which is coupled into the fiber channel and is transmitted through the fiber to the ignitor where the pulse is reflected by a dielectric coating on said ignitor that provides isolation of said LED pulse from said ignitor or initiator;

g) the reflected light is transmitted back through the fiber optic channel to a fold mirror that redirects the light into a photodetector which measures the loss and continuity of said channel;

h) a test result of said channel is reported to a computer controller; and i) said deflector increments the beam angle to the next fiber channel and steps (f) through (i) are repeated for each of said next fiber channel.

10. A laser initiated ordnance control safe and arm apparatus having no moving parts, comprising:

a laser beam source for providing laser beam power through fiber optics to an explosive ordnance device;

a laser beam control means for blocking said laser beam while said control means is inactivated and for passing said laser beam while said control means is activated;

an acoustically controlled laser beam deflector means for receiving said laser beam and for adjusting the direction of said laser beam based on acoustic radio frequency power at said deflector means, wherein said laser beam source is directed to at least one of a plurality of fiber optic channels after said adjusting;

a plurality of fiber optic channels coupled to said deflector means for providing laser beam power to at least one pyrotechnic ordnance;

a radio frequency means for providing radio frequency power signals to said deflector means; and a computer controller for controlling said deflector means, said radio frequency means, said laser beam source, said laser beam control means, and for performing a built-in-test of optics and electronics within said safe and arm apparatus.

11. The apparatus of claim 10, wherein said apparatus is coupled to a user control panel to enable said controller to receive test, arm, safe and fire commands from an operator and to provide a monitoring means for providing operational status information to said operator by testing and monitoring said laser beam source, said laser beam control means, said acoustically controlled laser beam deflector, said radio frequency means, and said plurality of fiber optic channels.

12. The apparatus of claim 10, further comprising optical splitting means coupled to at least one of said plurality of fiber optic channels wherein said optical splitting means provides a plurality of simultaneous event channels for simultaneous detonation of multiple pyrotechnic ordnance from said fiber optic channels.

13. The apparatus of claim 10, wherein said built-in-test performed by said controller provides GO, NO-GO and failure isolation information from said plurality of fiber optic channels and said apparatus further comprises a low-power light source and a detector means, wherein the integrity of fiber optics of said apparatus is checked during said built-in-test by the transmission of a low-power test-light source from said low-power light means to each said pyrotechnic ordnance coupled to said fiber optics and wherein the test-light source is reflected off said ordnance which is coated to reflect the test light wavelength and said reflected light is then detected by said detecting means and analyzed by said controller to determine optical integrity of said apparatus.

14. A pyrotechnic ordnance control safing and arming apparatus for laser initiated ordnance comprising:

a means for providing laser beam energy through a fiber optic network having a laser beam energy blocking and passing means to an explosive ordnance device for ignition or initiation;

a polarized activated laser beam energy blocking means positioned within said fiber optic network between said means for providing laser beam energy and said pyrotechnic ordnance, wherein said laser beam energy is delivered to said ordnance while said blocking means is inactivated and said laser beam energy is impeded while said control means is activated;

an acoustically controlled laser beam deflector means, positioned along said fiber optic network between said blocking means and said ordnance, for adjusting the direction of said laser beam energy based on acousto-optic deviation of said laser beam energy based on radio frequency power at said deflector means, wherein said laser beam energy may be directed to any of a plurality of selected fiber optic channels of said fiber optic network after said adjusting of said deflector means;

a radio frequency means for providing radio frequency interference to said deflector means; and a computer controller for controlling said means for providing laser beam energy, said laser energy blocking means, said deflector means, said radio frequency means, and for performing a built-in-test of said fiber optic network including said plurality of fiber optic channels.

15. The apparatus of claim 14, wherein said built-in-test is also performed on said means for providing laser beam energy, said laser energy blocking means, and said deflector means.

16. The apparatus of claim 15, wherein said means for providing laser beam energy is a solid state laser, said deflector means is an acousto-optical deflector, and said blocking means is a polarization switch.

17. The apparatus of claim 14, further comprising:

a operator monitoring means for monitoring built-in-test information; and a operator control means for providing operator control over operations by said apparatus.

* * * * *